US006070806A

United States Patent [19]

Barbakadze et al.

[11] Patent Number: 6,070,806

[45] Date of Patent: Jun. 6, 2000

[54] SLEEPER

[76] Inventors: Vladimir Shalvovich Barbakadze, ulitsa Veernaya, 7, korpus 2, kv.3, 119501, Moscow; Natalya Vasilievna Dudko, ulitsa Milashenkova, 10"a", kv.75, 127322, Moscow, both of Russian Federation

[21] Appl. No.: 09/053,028

[22] Filed: Apr. 1, 1998

[30] Foreign Application Priority Data

Apr. 3, 1997 [RU] Russian Federation ..... 97104840

[51] Int. Cl.[7] ..... E01B 3/00

[52] U.S. Cl. ..... 238/85; 238/84; 238/94

[58] Field of Search ..... 238/29, 94, 30, 238/54, 83, 85, 88, 115, 84

[56] References Cited

U.S. PATENT DOCUMENTS

| | | | |
|---|---|---|---|
| 691,586 | 1/1902 | Bender | 238/30 |
| 799,981 | 9/1905 | Frye | 238/30 |
| 857,907 | 6/1907 | Schaeffer | 238/30 |
| 909,378 | 1/1909 | Dunson | 238/88 |
| 1,011,335 | 12/1911 | Flaig | 238/30 |

FOREIGN PATENT DOCUMENTS

| | | | |
|---|---|---|---|
| 1276717 | 12/1986 | Russian Federation | 238/83 |
| 1276717 A1 | 12/1986 | Russian Federation | 238/122 |
| 1276719 A1 | 12/1986 | Russian Federation | 238/122 |
| 1772284 | 10/1992 | Russian Federation | 238/83 |

OTHER PUBLICATIONS

V. Sh. Barbakadze "Automation, optimization, modeling in the process of designing constructions and structures" Moscow, "Stroyizdat", 1991, pp. 93–94.

*Primary Examiner*—Mark T. Le

*Attorney, Agent, or Firm*—Nath & Associates; Gary M. Nath; Gregory B. Kang

[57] ABSTRACT

The sleeper (tie) comprises a body which has a variable cross section along its length and is made from reinforced polymer concrete with a dispersed reinforcement in the form of steel or synthetic fibres or both the one and the other together, which fibres compose 5–7% of the total mass of the body of the sleeper, are of different length and have a different percent of content depending on the type of fibre. At the points of fastening the rails, inserts are provided in the body, the height of the inserts satisfying the relationship: $2/3\ H_1 \geqq H_2 > 1/3\ H_1$, where $H_1$ is the height of the highest portion at each end of the body of the sleeper, $H_2$ is the height of the insert. The upper face of the middle part of the body is positioned higher than the lower face of the insert by a value $\Delta H$ which is within the limits $0.5(H_1-H_2) > \Delta H > 0.1(H_1-H_2)$. Metallic and wooden inserts of various geometric shape are used.

14 Claims, 3 Drawing Sheets

SLEEPER

FIELD OF THE INVENTION

The invention relates to the building field and may more exactly relate to the construction of sleepers which can be used when constructing railroad structures, especially when the construction is conducted in aggressive media.

BACKGROUND ART

Together with the increase in the intensity of railroad traffic, the increase in the speed of the rolling stock and with the introduction of longer trains, the problem of reinforcing the base under the rails becomes acute. At present, concrete sleepers, which are more durable and have a longer life than traditional wooden sleepers, are widely used throughout the world. However, it is known that concrete sleepers have a greater stiffness which causes an increase in the stresses in the upper track structures and results in disturbances thereof. Stiffness of the track, as measurements show, is three and more times greater in the case of concrete sleepers than in the case of wooden sleepers, and this in turn has a negative effect on the stability of the track and on the operation of elements interacting therewith. A substantial disadvantage of concrete sleepers is their low resistance to corrosion in segments of track exposed to aggressive media, which substantially reduces their service life. Operating and manufacturing defects are also substantial.

At present sleepers are known which are made from reinforced polymer concrete, including therein at least one polymer capable of hardening, an appropriate hardener and filler with dispersed reinforcement with fibres. In particular, the use of furan polymer concrete, produced on the base of furfural acetone monomers, in rail beds is known. The durability of polymer concrete on the base of furfural acetone resins is determined primarily by the chemical activity of the binder and fillers such as gravel, sand, andesite flour. The hardener and different modifying components have some effect on the durability. The greater resistance of polymer concrete with dispersed reinforcement when a load is applied a multiple number of times makes this material especially appealing for the manufacture of sleepers. It should be noted that the possibility of using another type of polymer concrete is not excluded.

A sleeper is known which is disclosed in SU, A, 1276717, SU, A, 1276719, and has a body with a cross section which varies along the length of the sleeper, the body being made of reinforced polymer concrete with dispersed reinforcement in the form of steel and synthetic fibres, and with at least two inserts, the modulus of elasticity of the material of which is less than the modulus of elasticity of the body of the sleeper, at the points where it is presupposed the rails will be secured.

In spite of the achieved reduction of stiffness as compared with concrete sleepers, which substantially improves the property of resistance of the structure to the action of rolling stock, a disadvantage of the known sleeper is its greater stiffness as compared with a wooden sleeper, which results in substantial dynamic loads on the track and the rolling stock, and also substantial specific consumption of expensive materials—components of polymer materials (furfural acetone monomer, benzenesulphonic acid—hardener).

SUMMARY OF THE INVENTION

The main object of the invention is to reduce dynamic loads on the track and the rolling stock when the latter moves along a railroad track.

Another object is to ensure the possibility of adjusting the stiffness of the sleeper within the limits of plasto-elastic deformations, which are sufficient to ensure the carrying capability of the structure in respect of two groups of limiting states—strength and deformation.

A third object is to substantially increase the service life of the sleeper.

A fourth object is to improve the reliability of the sleeper.

And a fifth object is to reduce the specific consumption of expensive materials.

These and other objects are achieved in that in a sleeper comprising a body, having a variable cross section along the length thereof and made of reinforced concrete with dispersed reinforcement, and at least two inserts of a material, the modulus of elasticity of which is less than the modulus of elasticity of the body of the sleeper, the height of the inserts satisfies the relationship:

$$2/3H_1 \geqq H_2 > 1/3H_1,$$

where $H_1$ is the height of the highest portion at each end of the body of the sleeper, mm;

$H_2$ is the height of the insert, mm, the upper face of the middle part of the body of the sleeper is positioned higher than the lower face of the insert by a value which satisfies the relationship:

$$0.5(H_1-H_2) > \Delta H > 0.1(H_1-H_2),$$

where $\Delta H$ is the distance in height between the upper face of the middle part of the body and the lower face of the insert, mm; wherein the aforesaid reinforced polymer concrete has dispersed reinforcement in the form of steel and/or synthetic fibres which compose 5–7% of the total mass of the body of the sleeper.

It is desirable that the steel and/or synthetic fibres be of different length, wherein when only steel fibres are used it is preferable that 50% of their total amount have a length of 5 mm, 25%—10 mm and 25%—15 mm, when only synthetic fibres are used—50% of their total amount would also have a length of 5 mm, 25%—7 mm, 25%—10 mm, and when steel and synthetic fibres are used together, 25% would be steel fibres with a length of 5 mm, 25% would be synthetic fibres with a length of 5 mm, 15%—steel fibres with a length of 10 mm, 15%—the same with a length of 15 mm, 10%—synthetic fibres with a length of 7 mm and 10%—the same with a length of 10 mm.

In order to reduce the weight of the construction and solve the problems of attaining optimum specific consumption of expensive materials (components of the polymer concrete) and the possibility of a wide range of adjustment of the modulus of elasticity of the material (12000–25000 MPa), which in turn results in ensuring a wide range of adjustment of the stiffness of the structure, it is advisable to combine wastes of the wood-working industry with the mass of polymer concrete, in particular to introduce wooden chips (dry production wastes) of sizes not larger than the sizes of the fractions of a coarse aggregate into that aggregate in a volume not more than 25% of the total volume of the coarse aggregate, and to introduce sawdust (also dry production wastes) into a fine aggregate in a volume which is not more than 25% of the total volume of the fine aggregate. The dry production wastes of the wood-working industry can be preliminarily treated with corresponding reagents to achieve a better combination between them and the components of the polymer concrete.

When it is necessary to achieve minimum stiffness of the structure, it is preferable to increase the percentage content of the wastes of the wood-working industry, but within the limits dictated by satisfaction of the strength characteristics of the structure.

In order to strengthen the body of the sleeper, a prestressed reinforcement, positioned symmetrically relative to the longitudinal axis of the body, can be additionally introduced into the body. Wherein it is desirable that the inserts be made metallic with teeth on the base surface, that they be mounted on an adhesive layer and that a plate be mounted under each insert having dimensions in plan equal to the dimensions of the insert, the plate being made of plasticised polymer concrete with dispersed reinforcement, with the ratio of the modulus of elasticity of the plate material to the modulus of elasticity of the remaining part of the body being 1:3.5, and being positioned above the location of the additional, prestressed reinforcement, wherein the thickness of the plates should satisfy the relationship:

$$0.12H_1<H_3<0.24H_1,$$

where $H_3$ is the thickness of the plate, mm.

It is possible in another embodiment of the sleeper that the inserts be wooden, and that an adhesive layer be provided in the zone of location of each insert. In that case the to body of the sleeper may preferably be reinforced with a steel wire skeleton, while the middle part of the body between the wooden inserts may be made with at least one through hole.

In a preferable embodiment, each wooden insert may be made in the form of a truncated pyramid having bases in the form of hexagons, two sides of each of which are parallel to the longitudinal axis of the body, while the four other sides are positioned at an angle $\delta=7–33°$ to the transverse axis of the body, wherein the body has an additional prestressed reinforcement.

In another embodiment, each wooden insert is preferably made in the form of a composite prism, which in a vertical direction is made of upper and lower sections joined by an adhesive composition, the prism having bases in the form of hexagons, two sides of each of which are parallel to the longitudinal axis of the body and form with adjacent sides two oppositely positioned right angles and a pair of obtuse angles $\gamma$, determined according to the equation:

$$\gamma=90°+\alpha.$$

Between the said right and obtuse angles there located a pair of opposite by positioned obtuse angles $\beta$, determined by the equation:

$$\beta=180°-\alpha.$$

where $\beta$, $\gamma$ are obtuse angles of the hexagons, degrees;

$\alpha$ is the angle between the transverse axis of the body and a side of the hexagon positioned inclined with regard to the axes of the body, degrees, wherein the wooden fibres of the upper section of the insert prism are oriented parallel to the longitudinal or transverse axis of the body, of the lower—perpendicular, wherein the height of the lower section satisfies the relationship:

$$0.25H_2<H_4<0.5H_2,$$

where $H_4$ is the height of the lower section of the insert, mm.

In the third preferable embodiment, wooden inserts can possibly be made in the form of truncated pyramids, the upper and lower bases of which have the form of a rhombus, one pair of sides of which is positioned at an angle $\rho$ to the transverse axis of the body, while the other pair of sides—perpendicular, wherein the aforesaid inclined sides of the bases of the first and second inserts, which are positioned at an angle to the transverse axis of the body, form an angle $\epsilon=2\rho$ therebetween, the magnitude of which exceeds by two times the aforesaid angle $\rho$ of inclination of the sides of the rhombus of each aforesaid insert relative to the transverse axis of the body.

It is advisable when there is a steel wire skeleton in the body and, at least, one through hole in the middle part of the body that the wooden inserts be made with a width in plan less than the width of the body, and with their top face protruding above the upper surface of the body. In that case It is desirable that the inserts be made in the form of inverted truncated pyramids, with rectangles lying in the bases thereof, the rectangles oriented with their long sides along the longitudinal axis of the body, while the number of inserts at the points of fastening each rail should be equal to at least two.

Another embodiment of realization of the sleeper is possible with both wooden and metallic inserts, the number of which at the points of fastening each rail is equal to at least two, wherein the lower surface of the body in the direction of its transverse axis is positioned at an angle relative to the upper surface, there is at least one through hole in the body in the middle part between the inserts, and the upper face of the inserts protrudes above the upper face of the body.

BRIEF DESCRIPTION OF THE DRAWINGS

Further on the invention will be explained by a description of concrete embodiments and by the appended drawings in which.

DETAILED DESCRIPTION OF THE PREFERRED EMBODIMENTS

Figure 1:
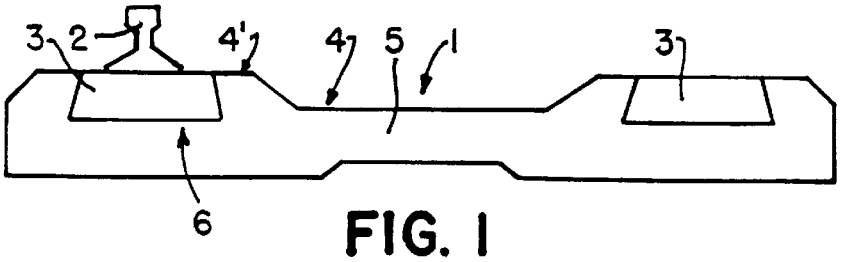
FIG. 1 shows a sleeper according to the invention, schematically, a general view.

A sleeper, shown in a general view in FIG. 1, comprises a body 1 of variable cross section along the length thereof which is made of reinforced polymer concrete with dispersed reinforcement. At the points where the rails 2 are fastened, inserts 3 are mounted in the body 1 of the sleeper. The body 1 of the sleeper is preferably made of furan polymer concrete which is produced on the base of furfural acetone monomers. The height $H_2$ of the inserts 3 satisfies the relationship:

$$2/3H_1 \geq H_2 > 1/3H_1,$$

where $H_1$ is the height of the highest portion at each end of the body 1 of the sleeper, mm.

$H_2$ is the height of the insert, mm.

An upper face 4 of a middle part 5 of the body 1 is positioned higher than a lower face 6 of the inserts 3 by a value $\Delta H$ which satisfies the relationship:

$$0.5(H_1-H_2) > \Delta H > 0.1(H_1-H_2),$$

where $\Delta H$ is the distance in a vertical direction between the upper face of the middle part of the body and the lower face of the inserts, mm.

Dispersed reinforcement of polymer concrete is made with high-strength steel or synthetic or steel and synthetic fibres (Ø0.1–0.3 mm). The amount of fibres in the total mass of the body of the sleeper is 5–7%.

The fibres used for reinforcement are of different length. When only steel fibres are used during reinforcement, 50% of their total amount have a length of 5 mm, 25% have a length of 10% and 25% a length of 15 mm. When only synthetic fibres are used, 50% of their total amount also have a length of 5 mm, 25% have a length of 7 mm, 25% a length of 10 mm. When steel and synthetic fibres are used together, 25% are steel fibres with a length of 5 mm, 25% are synthetic fibres with length of 5 mm, 15% are steel fibres with a length of 10 mm, 15% steel fibres with a length of 15 mm, 10% are synthetic fibres with a length of 7 mm, and 10% are the same with a length of 10 mm.

The fibres may be preliminarily treated with appropriate reagents, for example, with a mixture of furfural acetone monomer and benzenesulphonic acid, which promote the achievement of maximum adhesion of the surface of the fibres to the polymer concrete.

The body of the sleeper may be manufactured in accordance with a method which is known by itself and is described, for example, in the book by V. Sh. Barbakadze "Automation, optimization, modeling in the process of designing constructions and structures," Moscow, "Stroyizdat," 1991, pp. 93–94.

In the general case, a usual reinforcement 7, made in accordance with the design of the construction, is put in a mould, inserts 3 are also put in, then a dry mixture (fine aggregate, coarse aggregate and dispersed reinforcement, i.e. high-strength steel and/or synthetic fibres) is prepared. All the components are thoroughly mixed and placed in the mould. A mastic of polymer materials is simultaneously prepared. For this a monomer is mixed with a hardener and additives of a microfiller. The dry mixture placed in the mould is impregnated under pressure with the prepared mastic. The article is held depending on the composition at polymerisation (hardening) corresponding to the technology with the possible use of super-high frequencies. After a period of time sufficient for complete polymerisation, the finished article is taken out of the mould for further use according to its purpose. Other types of building materials, polymer concretes, satisfying the technological requirements of this invention, may be used. Thus, for example, when concrete with plasticising additives is used, the mastic is prepared accordingly from cement paste and plasticising additives, which can also be interpreted as a version of polymer concrete material (synthesis of concrete with plasticising polymer additives).

In all cases, in order to reduce the specific consumption of expensive materials, to reduce the weight, and also to reduce the modulus of elasticity, which result in a reduction of the stiffness, dry wastes of the wood-working industry can be introduced into a conglomerate of coarse and fine aggregate.

Figure 2:
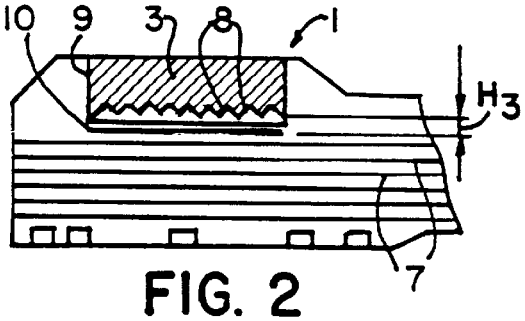
FIG. 2 shows the same as in FIG. 1, a longitudinal section, partially, magnified, with metallic inserts.
Figure 13:
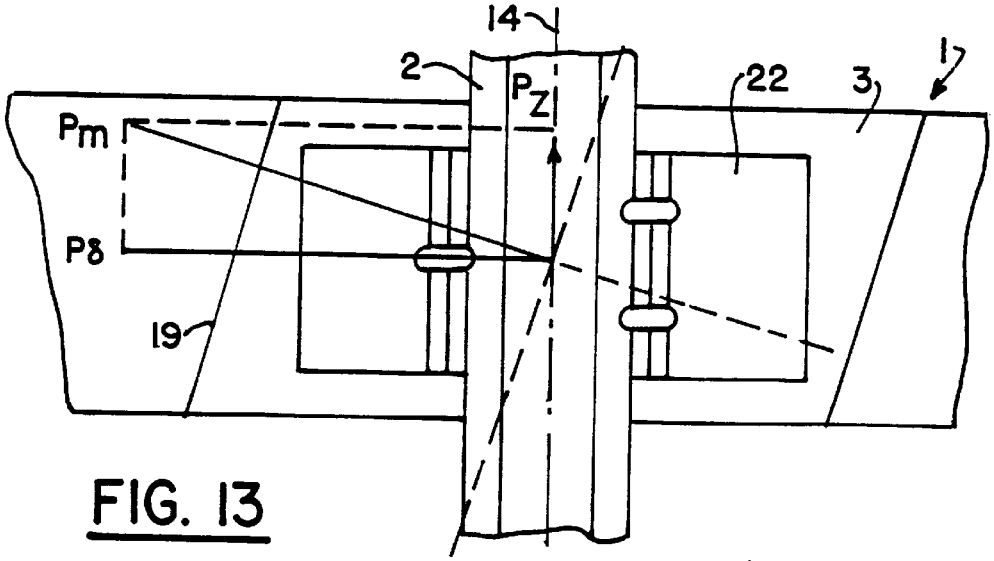
FIG. 13 shows the same as in FIG. 12, magnified, with a part of a rail.
Figure 12:
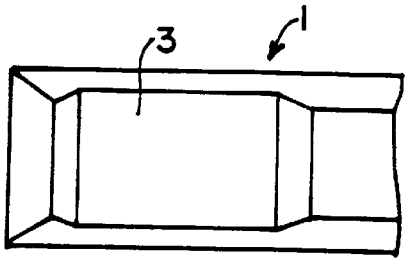
FIG. 12 shows a top view onto FIG. 2.

Metallic inserts 3, which have teeth 8 on the lower edge 6, are used in the embodiment of the sleeper shown in FIGS. 2, 12, 13. In this embodiment, prestressed reinforcement 7, placed symmetrically relative to the longitudinal axis of the body 1, is also used in addition to the usual reinforcement. Inserts 3 are mounted on a layer 9 of adhesive composition, for example, polymer adhesive. A plate 10 with dimensions in plan equal to the dimensions of the insert 3 itself and made of plasticised polymer concrete with dispersed reinforcement is positioned under the lower face 6 of each insert 3. The plates 10 have a thickness which satisfies the relationship:

$$0.12H_1 < H_3 < 0.24H_1,$$

where $H_3$ is the thickness of the plate, mm.

The plates 10 are positioned higher than the level at which the usual reinforcement and the additional prestressed reinforcement 7 are positioned. The ratio of the modulus of elasticity of the material of plates 10 to the modulus of elasticity of the remaining part of the body 1 is 1/3.5.

Figure 5:
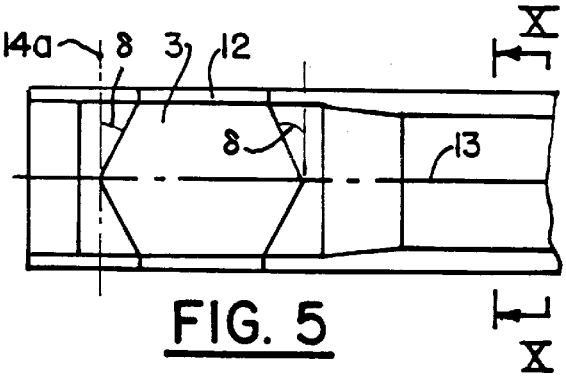
FIG. 5 shows a top view onto FIG. 3.
Figure 3:
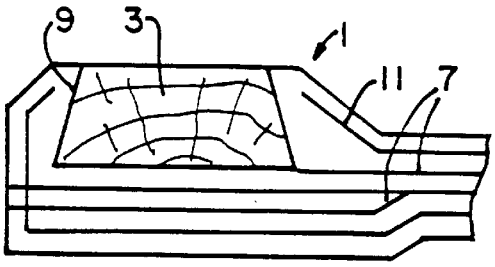
FIG. 3 shows the same as in FIG. 2 with wooden inserts in the form of truncated hexagonal pyramids.
Figure 10:
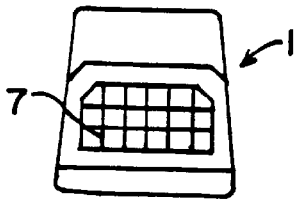
FIG. 10 shows a section along X—X in FIG. 5.
Figure 11:
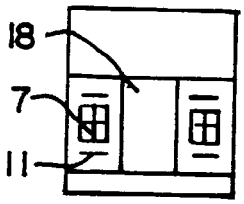
FIG. 11 shows a section along XI—XI in FIG. 6.

In the embodiment of the sleeper shown in FIGS. 3, 5 and 10, the inserts are made of wood, and there is a layer 9 of an adhesive composition in the zone in which each insert 3 is positioned. The body 1 in that example is additionally reinforced with a wire skeleton 11. The wooden inserts 3 can be of different shape. For example, they may be in the form of a truncated pyramid, the bases of which are hexagons, two sides 12 of each of which are parallel to the longitudinal axis 13 of the body 1 (FIG. 5), while the four other sides are positioned at an angle $\delta$=7–33° to a transverse axis 14*a* of the body 1.

Figure 6:
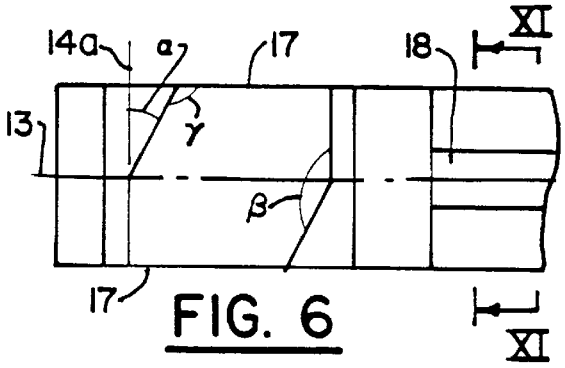
FIG. 6 shows a top view onto FIG. 4.
Figure 4:
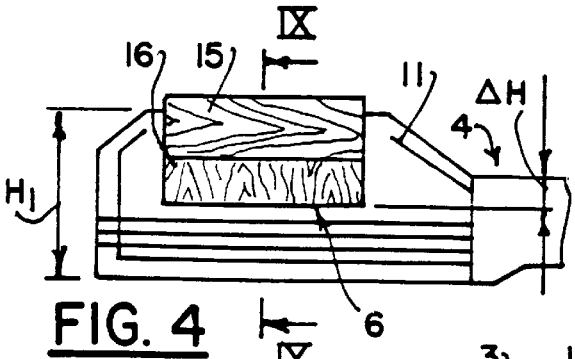
FIG. 4 shows the same as in FIG. 2 with wooden inserts which are composite in height.
Figure 9:
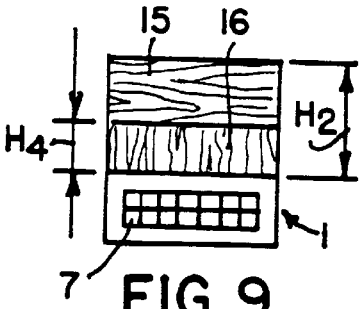
FIG. 9 shows a section along IX—IX in FIG. 4.

In another embodiment of the sleeper, shown in FIGS. 4, 6, 9, the wooden inserts 3 are made in the form of a prism and are composite in height of upper and lower sections 15, 16 joined by an adhesive composition. The prisms have bases which are hexagons, two sides 17 of each of which are parallel to the longitudinal axis 13 of the body 1 and form with adjacent sides two oppositely positioned right angles. The two pairs of obtuse angles $\beta$ and $\gamma$ are determined by the equations:

$$\beta = 180° - \alpha$$

$$\gamma = 180° + \alpha,$$

where $\alpha$ is the angle between the transverse axis of the body and a side of the hexagon which is positioned inclined with respect to axis of the body 1.

The wooden fibres of the upper section 15 of the insert 3 are oriented parallel to the longitudinal axis 13 or to the transverse axis 14*a* of the body 1, while the lower section 16 is perpendicular to those axes. The height of the lower section 16 satisfies the relationship:

$$0.25H_2<H_4<0.5H_2$$

where $H_4$ is the height of the lower section, mm.

In this embodiment of the sleeper, there is a through hole 18 in its middle part 5, which passes from the lower to the upper face of the body 1 of the sleeper.

Figure 7:
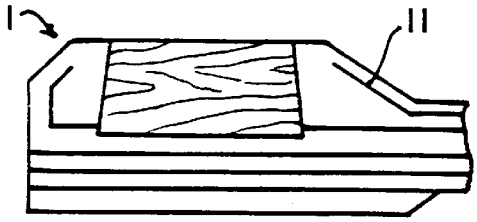
FIG. 7 shows the same as in FIG. 2, with wooden inserts in the form of a truncated pyramid with bases in the form of rhombuses.
Figure 8:
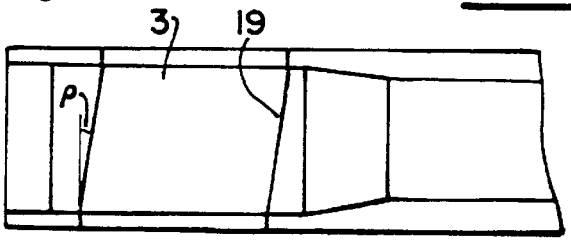
FIG. 8 shows a top view onto FIG. 7.
Figure 14:
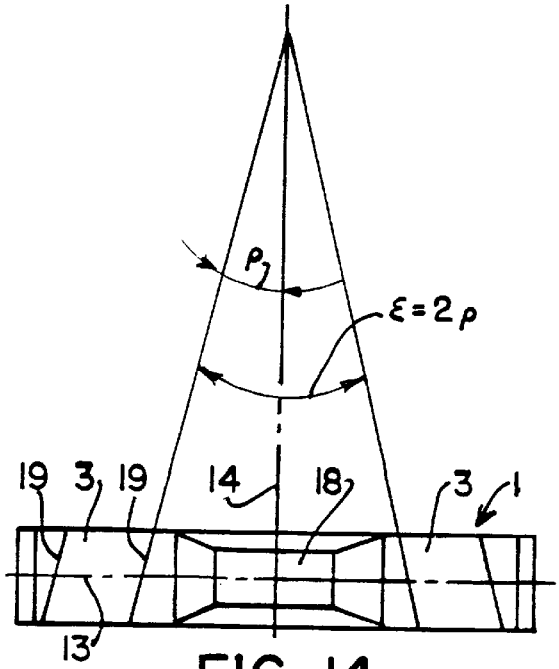
FIG. 14 shows a top view onto a sleeper with two inserts in the form of a truncated pyramid with the bases in the form of rhombuses.

Embodiments of a sleeper with wooden inserts 3 in the form of truncated pyramids are shown in FIGS. 7, 8, 14, wherein the upper and lower bases in plan have the form of a rhombus. One pair of sides 19 of the rhombus is positioned at an angle $\rho$ to the transverse axis 14 of the body 1, while the other pair of sides is perpendicular thereto. The sides 19 of the rhombus of the bases of the inserts 3, which are positioned at an angle $\rho$ to the transverse axis 14 of the body 1, form an angle $\epsilon$, the magnitude of which exceeds by two times the angle $\rho$ of inclination of the sides of the bases of the rhombus of each insert 3 relative to the transverse axis of the body 1, i.e. $\epsilon=2\rho$.

Figure 15:
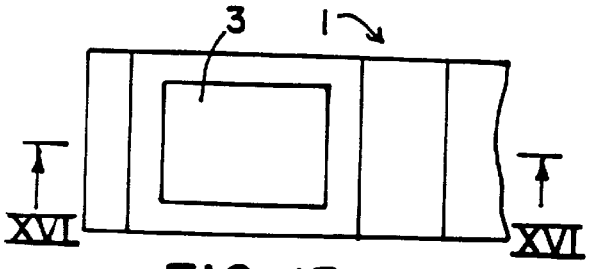
FIG. 15 shows a top view onto a sleeper with inserts, the width of which is less than the width of the sleeper body.
Figure 16:
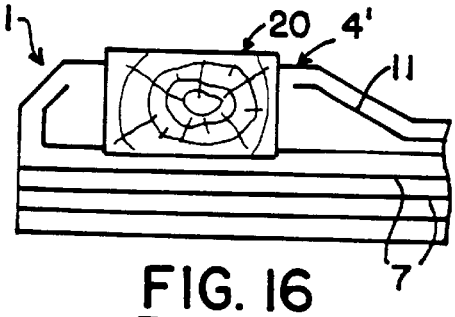
FIG. 16 shows a section along XVI—XVI in FIG. 15.

A sleeper is shown in FIGS. 15, 16 in which wooden inserts 3 in plan have a width which is less then the width of the body 1. Wherein an upper edge 20 of the inserts 3 protrudes above the upper edge 4' of the body 1, which prevents the rail from bearing on the body 1 of the sleeper. The inserts 3 in this embodiment are made in the form of rectangular parallelepipeds.

A sleeper is shown in FIGS. 17, 18, 19 and 20 in which the wooden inserts 3 are made in the form of inverted truncated pyramids, the bases of which are in the form of rectangles oriented with long sides 21 extending along the longitudinal axis of the body 1. The number of inserts 3 at the points of fastening each rail in this case is equal to at least two, in the example being described—two. In all, this sleeper has four inserts 3.

The configuration of the insert 3 shown in FIGS. 7, 8, 13, 14, makes it possible, if necessary, to replace a defective insert 3 at any time of the year with a new one without disassembling the rail and sleeper. Such inserts are easily pushed out and driven out with subsequent replacement with new ones, taking into account suitable tolerances.

An insert 3 is subjected to a complex dynamic forceful action from rolling stock. The vertical dynamic force of pressure of a wheel on the rail 2 (FIG. 13) is transmitted by the rail via a metallic fastening plate 22 (FIG. 13) onto an insert 3 and then via the insert 3 is redistributed directly to the sleeper structure. When the rolling stock moves, additional forces are created: a lateral force $P\delta$ directed parallel to the longitudinal axis of the body 1, a track displacement force $P_z$, especially on segments with an inverse inclination, which is directed perpendicular to the longitudinal axis of the body 1. The resulting force $P_m$ acts on the insert 3 perpendicular to its inclined side 19 of the base (if a rhombus), which ensures shear strength of the insert 3 along the transverse axis 14 of the body 1.

Figure 17:
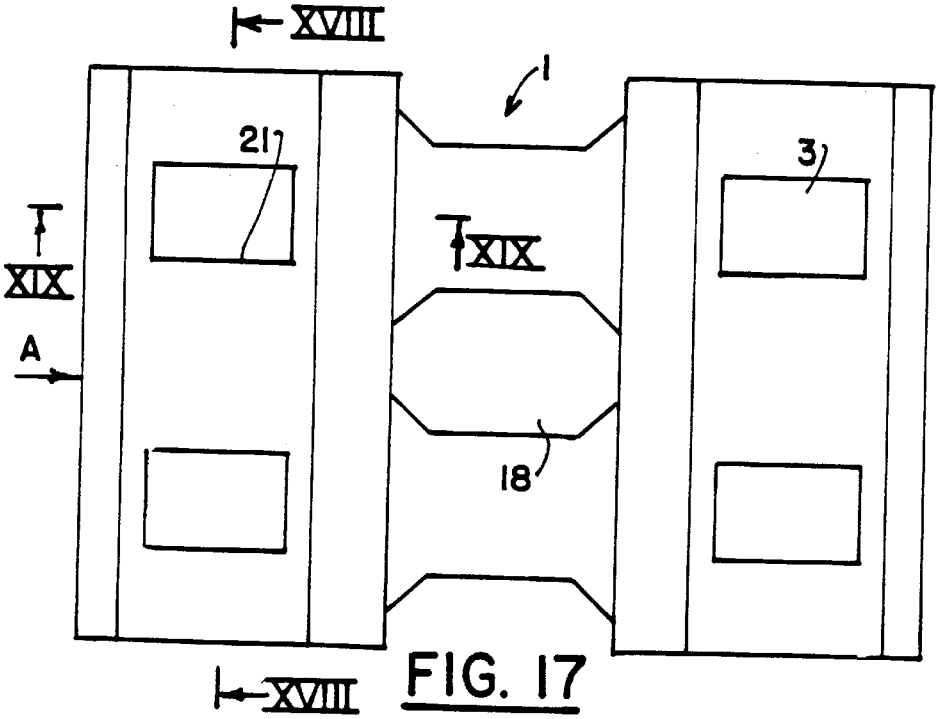
FIG. 17 shows schematically a top view onto a sleeper with four inserts, two inserts at the point of fastening each rail.
Figure 19:
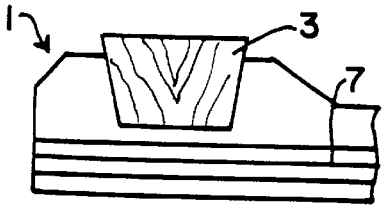
FIG. 19 shows a section along IXX—IXX in FIG. 17.
Figure 18:
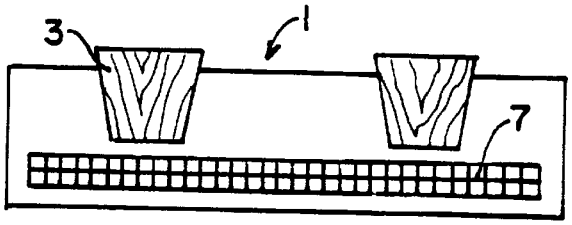
FIG. 18 shows a section along XVIII—XVIII in FIG. 17.
Figure 20:
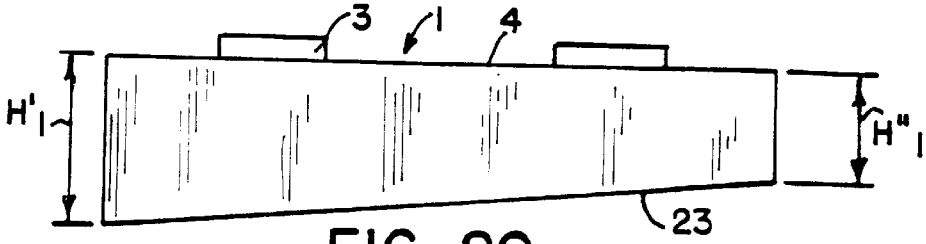
FIG. 20 shows a view along arrow A in FIG. 17.

The construction of the sleeper as shown in FIGS. 17 and 20 makes it possible to ensure a reduction of stiffness at points of conjugation of monolithic concrete structures of the track (trestles of retarders of sorting parks, abutments, tunnels) with the usual rail-sleeper track construction. At the aforesaid points an abrupt change in the stiffness of the rail base takes place, due to which residual (non-elastic) deformations of the track base accumulate, and as a result, there is a sharp increase in the labour needed to correct the track (raising and padding the track). It should also be noted that when leaving a concrete trestle of retarders, forces of inertia, increasing the settlement of the track, additionally act on the construction.

The sleeper shown in FIGS. 17, 20 is made in such a manner that a lower face 23 of the body 1 in the direction of its transverse axis is positioned at an angle relative to the upper face 4. The number of inserts 3 at the points of fastening each rail 2 is equal to two. There is at least one, in this example one, hole 18 in the middle part of the body 1 between the inserts 3.

In order to achieve a more gradual transition of the stiffness, the sleeper has a maximum height $H_1'$ equal to 250 mm which is selected on the basis of a minimum consumption of polymer concrete, a minimum height $H_1'$ equal to 150 mm—corresponding to the minimum ultimate strength. Such a construction of the sleeper makes it possible to increase its shear strength, i.e. to increase the stability of the rail base.

The use of the sleeper described above, having a construction on the base of furfural acetone monomer at the points of conjugation of monolithic concrete constructions of a rail base and the usual rail-sleeper construction of a track, makes it possible to substantially increase the stability of the base, prevent rapid accumulation of residual deformations therein, reduce its stiffness, i.e. ensure a smooth removal of stiffness from the monolithic concrete base to the sleepers. The high insulating properties of polymer concrete make it possible to remove insulating parts from the fastening unit, which simplifies the construction of the fastening unit and, consequently, increases its reliability.

The positive qualities of the proposed construction make it possible to reduce to a minimum such laborious work during regular maintenance as straightening the track by raising and padding the track. Use of this construction on segments in aggressive media also provides a substantial economical effect due to an increase in the service life. A reduction of the level of dynamic loads at the points of conjugation of different constructions of the rail base by laying the proposed sleepers as an intermediate element increases the service life of both the construction of the track and the rolling stock.

The economical effect from realization of the invention is determined first of all by the durability of the proposed sleepers, which in respect of their physico-mechanical characteristics according to preliminary evaluations can serve for more than 50 years in aggressive media in places where traditional constructions made from wood and concrete can only be suitable for service for several years.

Thus, use of the sleepers according to the invention makes it possible to obtain a technical result which is expressed by a reduction of the dynamic loads on the track and the rolling stock due to the creation of a construction with adjustable stiffness over a wide range along its length, ensuring its operation within the limits of plasto-elastic deformations which ensure carrying capability of the construction in respect of two groups of limiting states, and by a substantial increase of the service life, durability and reliability, and also by reduction of the consumption (specific consumption) of expensive materials.

We claim:

1. A sleeper comprising:

a body having a length, width and height, wherein at least said height is substantially less than said length and has a variable value along said length of said body of the sleeper, an upper face determined by said width and said length of said body of the sleeper, a lower face opposite said upper face, and also a first end part, a middle part and a second end part which are positioned successively along said length of said sleeper;

said body being made of reinforced polymer concrete including therein at least one polymer capable of hardening, an appropriate hardener and aggregate, with dispersed reinforcement with fibres, which fibres are selected from a group consisting of steel fibres, synthetic fibres, steel and synthetic fibres, wherein said fibres constitute 5–7% of the total mass of said body of said sleeper;

at least two inserts mounted in said body of the sleeper at predetermined points of fastening rails, said inserts being made each of a material, the modulus of elasticity of which is less than the modulus of elasticity of the material of said body of the sleeper, and each insert having a height, width, length which are oriented respectively in the directions of said height, width and length of said body of the sleeper, the lower face interacting with said body of the sleeper, and serving for interaction with said rail;

said height of said insert being selected, taking into account fulfillment of the relationship:

$$2/3H_1 \geq H_2 > 1/3H_1,$$

where $H_1$ is said height of the body of the sleeper at each end of the body of the sleeper, $H_2$ is said height of the insert;

said upper face of said middle part of said body being positioned higher than said lower face of said inserts by a value which satisfies the relationship:

$$0.5(H_1-H_2) > \Delta H > 0.1(H_1-H_2),$$

where $\Delta H$ is the distance in height between the upper face of the middle part of the body and the lower face of the insert.

2. A sleeper as in claim 1, wherein said fibres in the sleeper are said steel fibres, wherein 50% of the total amount of the steel fibres have a length of 5 mm, 25% have a length of 10 mm and 25% have a length of 15 mm.

3. A sleeper as in claim 1, wherein said fibres in said sleeper are said synthetic fibres, wherein 50% of the total amount of the synthetic fibres have a length of 5 mm, 25% have a length of 7 mm and 25% have a length of 10 mm.

4. A sleeper as in claim 1, wherein said fibres in said sleeper are said steel and synthetic fibres, wherein 25% are said steel fibres with a length of 5 mm, 25% are said synthetic fibres with a length of 5 mm, 15% are said steel fibres with a length of 10 mm, 15% are said steel fibres with a length of 5 mm, 10% are said synthetic fibres with a length of 7 mm, and 10% are synthetic fibres with a length of 10 mm.

5. A sleeper as in claim 1, wherein said reinforced polymer concrete additionally includes dry wastes of a wood-working industry as a part of said aggregate;

said dry wastes have a fraction size which does not exceed corresponding sizes of coarse and fine fractions of said aggregate of the reinforced polymer concrete and a volume of the wastes is not more than 25% of a total volume of the aggregate.

6. A sleeper as in claim 3, wherein said inserts are made of metal and have teeth on said lower face;

plates of plasticised reinforced polymer concrete with dispersed reinforcement in accordance with a number of said inserts are mounted in said body of the sleeper, the plates having a length and width substantially equal to said width and length of said inserts and a thickness, each plate being placed under said lower face of a corresponding insert and said plates are fastened to said lower faces by a layer of adhesive;

said plates, the modulus of elasticity of which is 1/3.5 of said modulus of elasticity of said body of the sleeper, and said thickness of which is selected taking into account fulfillment of the relationship:

$$0.12H_1 < H_3 < 0.24H_1,$$

where $H_3$ is said thickness of said plate;

said body of the sleeper additionally includes a prestressed reinforcement which is distributed symmetrically relative to a longitudinal axis of said body and below the level at which said plates are positioned.

7. A sleeper as in claim 3, wherein said inserts are made of wood and are fastened to said body of the sleeper by a layer of adhesive composition.

8. A sleeper as in claim 7 which further comprises:

at least one through hole positioned in said middle part of said body and passing from said lower surface to said upper surface;

a prestressed reinforcement which is distributed in said body symmetrically relative to its longitudinal axis;

a steel wire skeleton in said body encompassing said prestressed reinforcement.

9. A sleeper as in claim 8, wherein each said wooden insert is made in a truncated pyramid form having bases in a form of hexagons, two sides of each of which are parallel to the longitudinal axis of said body, and four other sides are positioned at an angle $\delta$=7–33° to a transverse axis of said body.

10. A sleeper as in claim 7, wherein each said wooden insert is a prism with bases shaped as a hexagon, with two first opposing sides of each of said bases being parallel to a longitudinal axis of said body of the sleeper, with two second opposing sides being perpendicular to the longitudinal axis of said body of the sleeper and each said second opposing side forming with one of the first opposing sides a right angle and two third opposing inclined sides being inclined under an angle $\alpha$ to a transverse axis of the body of the sleeper, between the first sides and adjacent inclined sides a pair of oppositely, lying obtuse angles $$\gamma = 90° + \alpha$$

being formed and between the said second sides and adjacent inclined sides a pair of another oppositely lying obtuse angles $\beta = 180° - \alpha$ being formed;

each of said wooden inserts including an upper and a lower section of said prism, the height of said lower section satisfying the relationship $$0.25H_2 < H_4 < 0.5H_2$$

where $H_4$ is the height of the lower section of the insert, wood fibers of said upper section of said prism being oriented parallel to the longitudinal axis or the transverse axis of said body, and wood fibers of said lower section being oriented perpendicular to said wood fibers of said upper section.

11. A sleeper as claimed in claim 7, wherein each of said wooden inserts is formed as a truncated pyramid with a base shaped as a rhombus, said rhombus having a first pair of sides inclined at an angle to said transverse axis of said body, said rhombus having a second pair of sides perpendicular to said transverse axis of said body, said sides of the rhombus of said truncated pyramid base of one insert, which sides are inclined at an angle to said transverse axis of said body, forming another angle with the sides of the rhombus of said truncated pyramid base of another insert, which sides are also inclined at an angle to said transverse axis of said body, said another angle thus formed being twice the inclined angle of said first pair of sides.

12. A sleeper as in claim 8, wherein said width of said inserts is less than said width of said body, and said upper faces of said inserts protrude above said upper face of said body.

13. A sleeper as in claim 12, wherein said inserts have a form of inverted truncated pyramids with bases in a form of rectangles oriented with their long sides along the longitudinal axis of said body, wherein at least two of said inserts are provided in each said point for fastening a rail.

14. A sleeper as in claim 12, wherein said lower face of said body in the direction of the transverse axis of said body is positioned at an angle to said upper face of said body.

* * * * *

UNITED STATES PATENT AND TRADEMARK OFFICE

CERTIFICATE OF CORRECTION

PATENT NO. : 6,070,806
DATED : June 6, 2000
INVENTOR(S) : Barbakadze et al.

It is certified that error appears in the above-identified patent and that said Letters Patent is hereby corrected as shown below:

Claim 4,
Line 6, change "5mm" to -- 15mm --

Signed and Sealed this

Eighteenth Day of September, 2001

*Attest:*

Nicholas P. Godici

*Attesting Officer*

NICHOLAS P. GODICI
*Acting Director of the United States Patent and Trademark Office*